United States Patent [19]

Pirota

[11] Patent Number: 4,553,065

[45] Date of Patent: Nov. 12, 1985

[54] GETTER ASSEMBLY WITH IMPROVED SUPPORT

[75] Inventor: Franco Pirota, Milan, Italy

[73] Assignee: Saes Getters S.p.A., Milan, Italy

[21] Appl. No.: 549,405

[22] Filed: Nov. 7, 1983

[30] Foreign Application Priority Data

Nov. 23, 1982 [IT] Italy ..... 24382 A/82

[51] Int. Cl.[4] ..... H01J 29/94; H01K 1/52

[52] U.S. Cl. ..... 313/481; 313/558; 313/561; 445/55; 417/48

[58] Field of Search ..... 313/481, 558, 559, 561, 313/553; 417/48; 445/55

[56] References Cited

U.S. PATENT DOCUMENTS

| | | | |
|---|---|---|---|
| 3,381,805 | 5/1968 | della Porta et al. | 206/4 |
| 3,829,730 | 8/1974 | Reash et al. | 313/174 |
| 3,961,221 | 6/1976 | Benda et al. | 313/481 |
| 4,101,247 | 7/1978 | Pirota et al. | 417/48 |
| 4,221,991 | 9/1980 | Speigel | 313/481 |

FOREIGN PATENT DOCUMENTS

| | | |
|---|---|---|
| 12359 | 6/1980 | European Pat. Off. . |
| 2036019 | 1/1972 | Fed. Rep. of Germany . |
| 11453 | 2/1975 | Japan . |
| 1274289 | 5/1972 | United Kingdom . |
| 1417247 | 12/1975 | United Kingdom . |
| 1476339 | 6/1977 | United Kingdom . |
| 1578297 | 11/1980 | United Kingdom . |

*Primary Examiner*—Arthur Kellogg

*Attorney, Agent, or Firm*—Quaintance, Murphy & Presta

[57] ABSTRACT

A getter assembly is described having an improved support such that the points of contact with the glass wall of a cathode ray tube have as low a temperature as possible. An antenna position mounting can be attached to the lower side of the central disc-shaped form of the getter assembly formed from an upraised portion of the bottom wall of the ring container. Said mounting tab can extend outwardly without touching the internal wall of the container or its bottom wall, in the preferred embodiment there can be attached, for example by means of welding, a support means which has at least one concave surface facing towards the bottom of the container and situated in a plane perpendicular to the outwardly extended portion of the mounting tab. In any case, even if said support is attached to the bottom wall of the container, it has a first portion perpendicular to the tab and approximately parallel to the lower wall, a second portion integral with the first and which forms an angle with it and is at the same time approximately parallel to the lower wall, and a third portion integral with the second, perpendicular to said tab adapted to distance said container from said glass wall.

5 Claims, 7 Drawing Figures

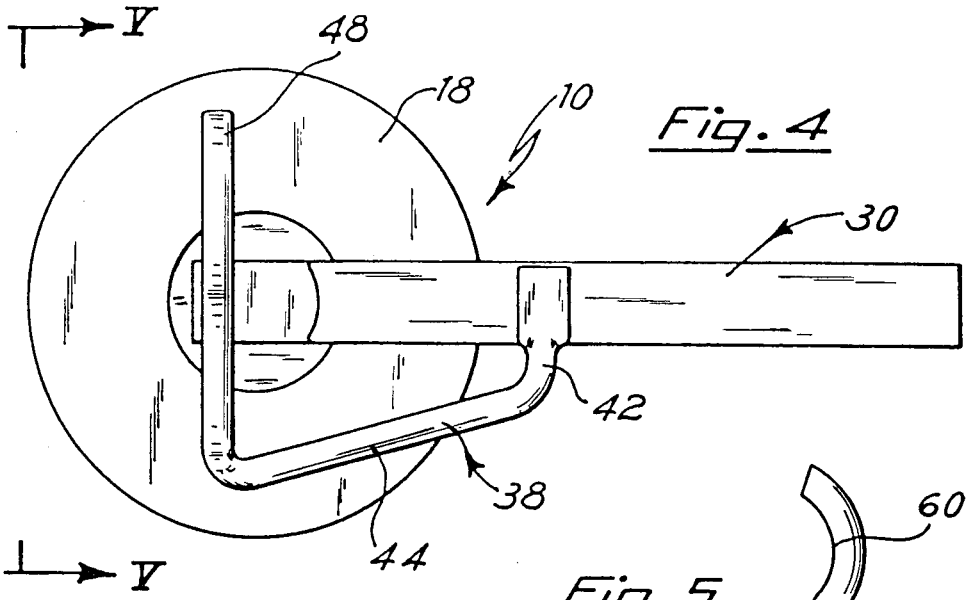
Fig. 4
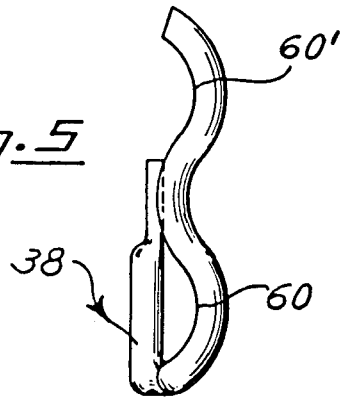
Fig. 5
Fig. 6
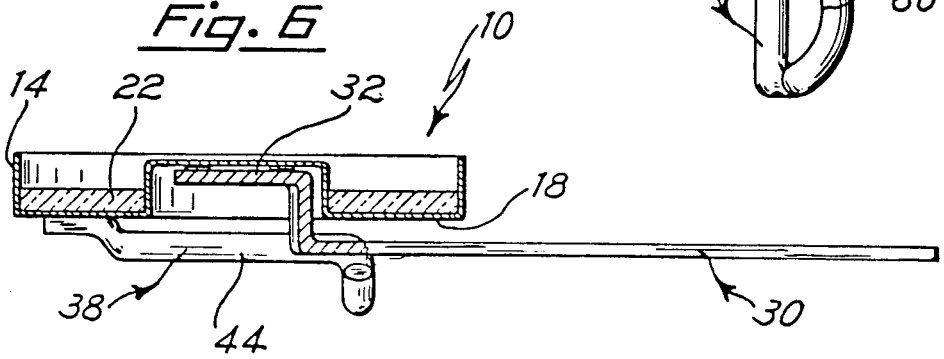
Fig. 7
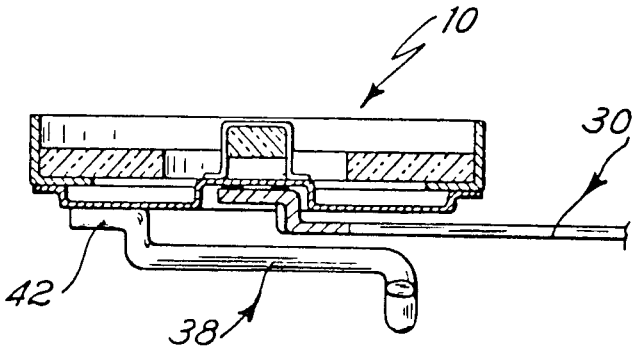

GETTER ASSEMBLY WITH IMPROVED SUPPORT

BACKGROUND TO THE INVENTION

The present invention relates to a getter assembly with an improved support to avoid high temperatures at the points of contact of the supports with the wall of the electron tube in which the getter device is located.

It is known that getter devices are widely used in tubes for the representation of visual images such as cathode ray tubes. In use the getter assembly is heated to a high temperature usually by means of high frequency induction, so that a gettering metal, normally barium, is caused to evaporate from the getter assembly. This can be located within the cathode ray tube in the "antenna" position or attached to the anode button but, whatever its position it is usually in usually in contact with the internal surface of the glass envelope of the cathode ray tube.

Unfortunately the high temperatures, even greater than 1000° C., reached by the getter device during evaporation of the gettring metal are such as to provoke rupture of the glass envelope. It has therefore become the normal practice to provide some tyoe of the thermal insualtion or support between the getter material container and the glass wall. Ceramic insulators have been used as described in U.S. Pat. No. 3,381,805 or metal wire supports as described in U.S. Pat. No. 4,101,247. Another type of support is described in Japanese Utility Model Publication No. 50-11453.

Unfortunately such insulating means or supports are costly or still have too high a temperature at the point of contact between the support and the glass envelope, especially when the getter device has a small diameter.

BRIEF OBJECTS OF THE INVENTION

It is therefore an object of the present invention to provide a means of relatively low cost which ensures that the points of contact of the getter assembly and the glass wall of a cathode ray tube remain at a sufficiently low temperature during evaporation of the getter metal, so that breakage of the glass envelope is prevented.

These and other objects advantages and characteristics of the getter assembly with an improved support according to the present invention will become more clear from the following detailed description of the preferred embodiments described as non-limiting examples with reference to the attached drawings in which:

BRIEF DESCRIPTION OF THE FIGURES

FIG. 4 is a taken from below of another embodiment of the present invention;

FIG. 5 is a view of an alternative of embodiment of only the support of the present invention taken along the arrows V—V of FIG. 4; and FIG. 6 and FIG. 7 are sectional views of further examples of known getter assemblies which use supports of the present invention.

DESCRIPTION OF THE INVENTION

Figure 1:
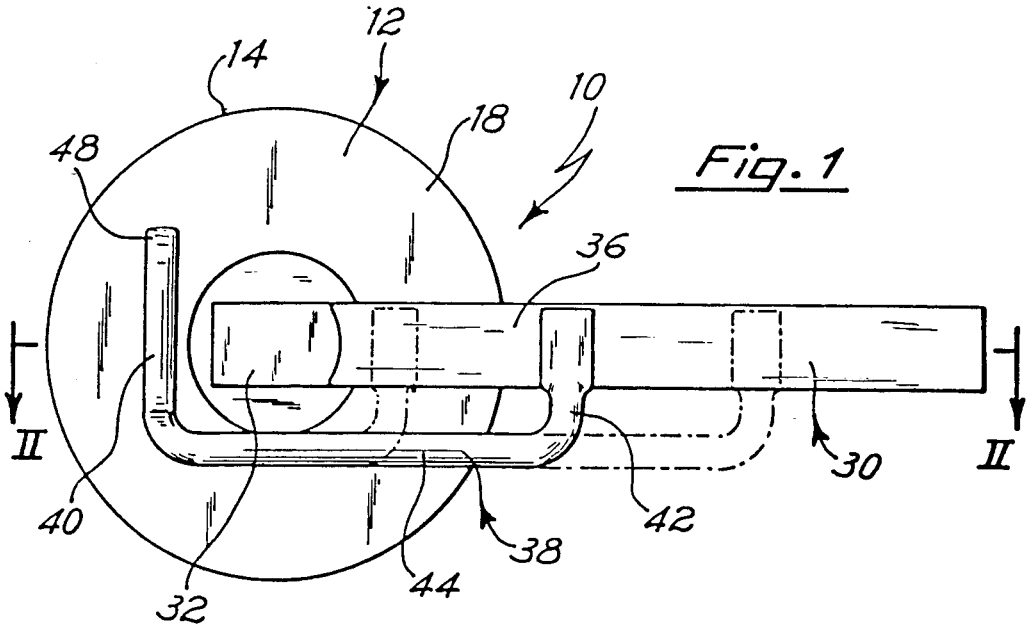
FIG. 1 is a shcematic view, of the under side of a getter assembly of the present invention.
Figure 2:
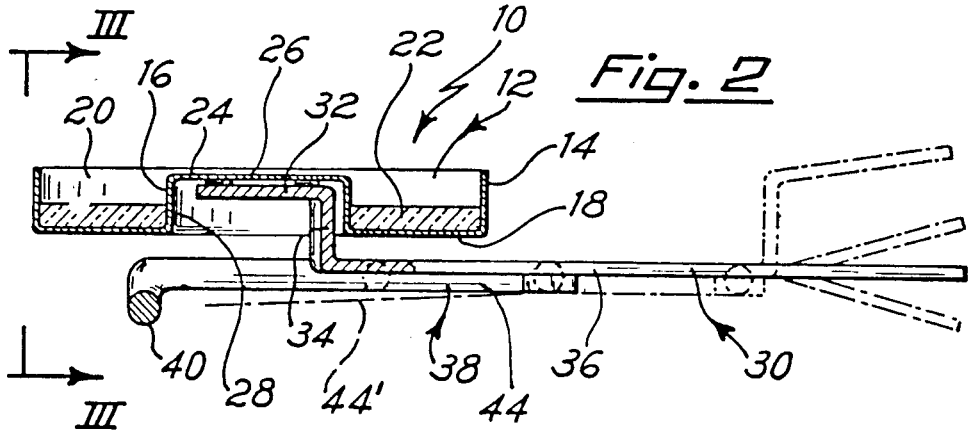
FIG. 2 is a schematic view of a section along line II—II of FIG. 1.
Figure 3:
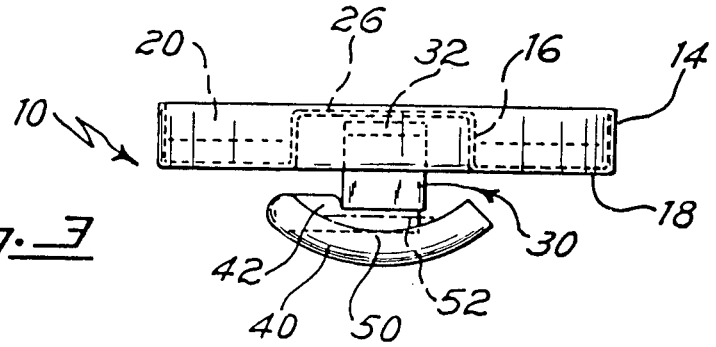
FIG. 3 is an end view in the direction of arrows III—III of FIG. 2.

Referring now to the figures, in which like parts are indicated with the same reference number, there is shown in FIGS. 1–3 a getter assembly 10 which comprises a getter material container 12, which is shown here as a ring but which could have any other form, with an external sidewall 14, an internal sidewall 16 and a bottom wall 18 which joints said two sidewalls defining in such a way an annular channel 20. Annular channel 20 contains gettering material 22 in the form of a powder, which generally comprises a mixture of an alloy of approximately 50% barium, 50% aluminium together with approximately an equal weight of nickel. By the term "getter material" as used here in the description and in the claims it is intended to means the material both before and after getter material vapour release. This term embraces both the materials in the form sold with the getter device and in the form in which it is found in an operating tube wherein the bulk of the getter metal has been evaporated from the material and is in the form of a film on the inside surfaces of the tube. Upper edge 24 of the internal sidewall is integrally formed around a disc element 26 to provide an upper raised bottom portion 28.

A mounting tab 30 is attached in a central zone of the disc-shaped element 26 by means of a horizontal welding zone 32. Horizontal welding zone 32 is integrally attached to a downwardly extending zone 34 which is distanced from internal sidewall 16 to reduce to a minimum heat transmission towards the mounting tab and the support, as will be described later.

The mounting tab 30 further comprises a zone 36 which extends outwardly and is situated in a plane substantially parallel to bottom wall 18, however it may have a slight angulation to guide the getter metal vapours in a suitable direction. In any case outwardly extending zone 36 does not touch bottom wall 18 and is preferably separated from it by at least 0.5 mm. This avoids that zone 36 of the mounting tab removes heat from the getter container through bottom wall 18 and so prevents formation of a colder zone of getter material 22 during the evaporation of getter metal vapours. Outwardly extending zone 36 extends to a distance which is greater than the radius of external side wall 14. In FIG. 2 there are shown by maens of dashed lines, on the right hand side of the drawing, several possible configurations of mounting tab 30, or rather of its zone 36, with inclinations in either one or the other sense respect ot the horizontal or with a discontinuity by means of a joining portion parallel or at least complanar with downwardly extending zone 34.

According to the invention a support means 38 is attached to mounting tab 30 and has a concave surface 40, facing bottom wall 18 and situated in a plane perpendicular to outwardly extending zone 36 of mounting tab 30 Support means 38, preferably formed from a metal wire, comprises a first portion 42 extending perpendicular to mounting tab 30 and approximately parallel to bottom wall 18. A second portion 44 integral with said first portion extends at an angle of substantially 90° relative to said first portion 42 and is approximately parallel to bottom wall 18;

In FIG. 1 and FIG. 2 there are indicated three different position for attaching support means 38 to mounting tab 30, of which the middle one is shown in continuous lines and the two at either side with dashed lines. In FIG. 2 there is also indicated as detail 44' an alternative variation of second portion 44 of the support, shown as a dashed line which has a slight inclination with respect to bottom wall 18. Portions 42 and 44 can however also be comprised of a single piece without bending. A third portion 48 is integrally attached to second portion 44 and extends perpendicularly to mounting tab 30 which initially curves downwardly and then upwardly thus forming a concave surface 50 (FIG. 3) facing the bottom wall 18.

A part of concave surface 50 may be flattened at 52 (dashed line in FIG. 3) to receive a ceramic member 54 if desired which may have the form of a wheel or cilinder etc. The third portion of concave surface 50 may be comprised of a multiplicity of concave surfaces 60, 60' as shown in FIG. 5. In this case it is preferable that third portion 48 is longer than when there is only one concave surface, for which reason second portion 44 can advantageously have the configuration shown in FIG. 4.

In FIG. 6 there is shown a cross-section view of a getter assembly in which supports means 38 is attached, instead of to mounting tab 30, directly to the bottom wall 18, from which however second portion 44 is slightly distanced to reduce heat transmission.

Finally FIG. 7 shows a known getter device of the DND type with a capsule containing a material able to liberate nitrogen, provided with a deflector, in which support means 38 of the present invention is attached to this deflector.

On the other hand support means 38, for some particular types of getter which have, in place of mounting tab 30 dixed to the central zone of the assembly, a bar mounting tab attached directly to the bottom of the getter, support means 38 can be welded by means of first portion 42 to said bar.

It is observed that the position in which support means 38 is attached to mounting tab 30 or to bottom wall 18 can be used as a reference point for the attachment of the antenna spring.

Although the invention has been described in detail with reference to certain preferred embodiments and uses it is intended that variations and/or modifications can be carried out while sill remaining within the spirit and scope of the invention.

I claim:

1. A getter assembly for cathode ray tubes comprising a container (12) of getter material having an external sidewall (14) and a bottom wall (18) which contains powdered getter material (22), a mounting tab (30) for attachment of the getter assembly to the cathode ray tube, said mounting tab extending radially outwards from a central upraised zone of the getter assembly, and a support means (38) in the form of a wire which distances the container (12) from the wall of the cathode ray tube characterized by the fact that said support (38) has a first portion (42) that extends in a direction perpendicular to the mounting tab and approximately parallel to the bottom wall (18); a second portion (44) integral with said first portion, which extends forming an angle with respect to the first portion (42), extending approximately parallel to the bottom wall (18); and a third portion (48) integral with and in continuation of said second portion, which extends perpendicularly to said mounting tab (30), curving initially downwardly and then upwardly to form a concave surface (50) facing said bottom wall (18) of the container.

2. A getter assembly according to claim 1 in which said concave surface (50) supports a ceramic.

3. A getter assembly according to claim 1 in which the third portion (48) of said support (38) has at least two concave surfaces

4. A getter assembly for cathode ray tubes comprising a container (12) of getter material having an external sidewall (14) and a bottom wall (18) which contains powdered getter material (22), a mounting tab (30) for attachment of the getter assembly to the cathode ray tube, said mounting tab extending radially outwards from the getter device, and a support means (38) in the form of a wire which distances the container (12) from the wall of the cathode ray tube characterized by the fact that said support (38) has a first portion (42) that extends in a direction perpendicular to the mounting tab and approximately parallel to the bottom wall (18); a second portion (44) integral with said first portion, which extends forming an angle with respect to the first portion (42), extending approximately parallel to the bottom wall (18), and a third portion (48) integral with and in continuation of said second portion, which extends perpendicularly to said mounting tab (30); curving initially downwardly and then upwardly to form a concave surface (50) facing said bottom wall (18) of the container; wherein said first portion (42) is attached to an outwardly extending zone (36) of said mounting tab (30) which is fixed at one end zone (32) to an upraised central zone (26) of the getter assembly.

5. A getter assembly for cathode ray tubes comprising:

A. A container (12) which contains powdered getter material (22), said container (12) having an external sidewall (14), an internal sidewall (16) and a bottom wall (18) which joins said two sidewalls, said internal sidewall (16) having an upper edge (24) integrally formed around a disc element (26);

B. a mounting tab (30) for attachment of the getter assembly to the cathode ray tube, said mounting tab (30) being attached to the disc element (26) and extending radially outward from the getter assembly; and C. a support means (38) in the form of a wire which distances the container (12) from the wall of the cathode ray tube characterized by the fact that said support means (38) has a first portion (42) that extends in a direction perpendicular to the mounting tab and approximately parallel to the bottom wall (18), a second portion (44) integral with said first portion which extends forming an angle with respect to the first portion (42), extending approximately parallel to the bottom wall (18), and a third portion (48) integral with and in continuation of said second portion, which extends perpendicularly to said mounting tab (30) curving initially downwardly and then upwardly to form a concave surface (50) facing said bottom wall (18) of the container.

* * * * *

UNITED STATES PATENT AND TRADEMARK OFFICE

CERTIFICATE OF CORRECTION

PATENT NO. : 4,553,065
DATED : November 12, 1985
INVENTOR(S) : FRANCO PIROTA

It is certified that error appears in the above-identified patent and that said Letters Patent are hereby corrected as shown below:

Column 4, Line 8, after "surfaces", add --(60,60').--

Signed and Sealed this

*Fourth* Day of *March 1986*

[SEAL]

*Attest:*

DONALD J. QUIGG

*Attesting Officer*

*Commissioner of Patents and Trademarks*